United States Patent [19]

McReynolds

[11] 4,086,712

[45] May 2, 1978

[54] BUCKET CONSTRUCTION HAVING IMPROVED REINFORCING MEANS

[75] Inventor: Charles P. McReynolds, Aurora, Ill.

[73] Assignee: Caterpillar Tractor Co., Peoria, Ill.

[21] Appl. No.: 783,101

[22] Filed: Mar. 31, 1977

[51] Int. Cl.[2] ..... E02F 3/70

[52] U.S. Cl. ..... 37/118 A; 214/145 R

[58] Field of Search ..... 37/118 R, 118 A, 117.5, 37/141 R, 141 T, 142 R; 214/145 R, 145 A

[56] References Cited

U.S. PATENT DOCUMENTS

| | | | |
|---|---|---|---|
| 2,838,856 | 6/1958 | Buisse | 37/142 R |
| 3,853,232 | 12/1974 | Oke et al. | 37/118 R X |

FOREIGN PATENT DOCUMENTS

| | | | |
|---|---|---|---|
| 1,222,056 | 2/1971 | United Kingdom | 37/118 R |

*Primary Examiner*—Clifford D. Crowder
*Attorney, Agent, or Firm*—Wegner, Stellman, McCord, Wiles & Wood

[57] ABSTRACT

A material handling bucket structure having a relatively thin shell defining a bottom wall having a front edge portion and an upturned rear portion. A blade is secured to the front edge portion of the shell. First and second generally straight longitudinal ribs are secured to the underside of the shell in transversely spaced relationship. Each rib extends from adjacent the front edge portion of the shell rearwardly to the rear portion thereof and includes a front rectilinear portion and a rear rectilinear portion. Third and fourth outer ribs are secured to the underside of the shell to extend forwardly and transversely outwardly from the rear portion of the first and second ribs, respectively, to adjacent the front edge portion of the shell. A paddle plate is spaced below the shell and secured to the ribs to define therewith and with the shell a box section extending rearwardly from the blade to rearwardly of the third and fourth ribs and the front portion of the first and second ribs.

19 Claims, 4 Drawing Figures

BUCKET CONSTRUCTION HAVING IMPROVED REINFORCING MEANS

BACKGROUND OF THE INVENTION

1. Field of the Invention

This invention relates to material handling bucket structures and in particular to means for reinforcing the shell portion of such bucket structures and providing connecting means for attaching the bucket structure to a loader linkage or the like.

2. Description of the Prior Art

In U.S. Pat. No. 3,853,232 of Stanley A. E. Oke et al, which patent is owned by the assignee hereof, an improved bucket construction is disclosed and claimed wherein cooperating rib and plate means are provided for defining a reinforcement box section. The rib means thereof are continued rearwardly to define means for connecting the loader linkage to the bucket structure, thus permitting the reinforcement means to transfer the manipulating forces to the bucket shell in use.

By use of the box structure reinforcement, the shell may be maintained relatively thin and light for facilitated material handling and minimizing of power requirements.

SUMMARY OF THE INVENTION

The present invention comprehends an improved reinforcement and connecting means for use in such a material handling bucket structure comprising a further improvement over that of the above described Oke et al patent.

More specifically, the present invention comprehends the provision of such a reinforcing and mounting means being effectively defined by a pair of spaced, generally straight ribs underlying the bottom and rear portions of the shell and a pair of outwardly directed third and fourth ribs extending from a rear portion of the first and second ribs, respectively, to adjacent the front edge of the shell.

A paddle plate is secured to the ribs to define therewith and the shell a box reinforcement structure providing further improved reinforcement and force transmission capabilities over that of the Oke et al patent structure.

More specifically, the third and fourth ribs may define rectilinear front portions with the paddle plate defining side edge portions engaging the sides of the rectilinear front portions.

First and second brace members may be provided extending between the blade mounted on the forward edge of the shell, and the forward ends of the third and fourth ribs, respectively.

The paddle plate may be provided with first and second slots aligned with the first and second rib front portions, respectively, with weld means being provided in the slots to secure the paddle plate to the ribs.

In the illustrated embodiment, the front and rear portions of the first and second ribs are discrete rib members.

In the illustrated embodiment, the front end of the rear portion of the first and second ribs overlaps the rear end of the front portion thereof.

The third and fourth ribs may define rear portions overlying a rear portion of the paddle plate.

A wear plate may be provided underlying the rear portion of the paddle plate and a second wear plate may underlie the paddle plate to extend forwardly of the rear portion of the first and second ribs to adjacent the front end of the front portion of the first and second ribs.

The rearward wear plate may project rearwardly beyond the paddle plate.

A crossbar may be secured in overlying relationship to the paddle plate between the first and second rib rear portions.

Each of the first and second ribs define an upper surface conforming to the confronting undersurface of the shell and have a planar bottom surface abutting the upper surface of the paddle plate.

The front edge of the paddle plate may be secured to the blade.

The rear portions of the first and second ribs may be provided with linkage connection apertures.

A cross plate may be secured between the first and second rib rear portions rearwardly of the paddle plate and to the rear portion of the shell.

A stop plate may be secured to the underside of the cross plate intermediate the first and second rib rear portions.

The reinforcing and connection means of the present invention is extremely simple and economical of construction while yet providing a further improved structural configuration in such material handling bucket structures.

BRIEF DESCRIPTION OF THE DRAWING

Other features and advantages of the invention will be apparent from the following description taken in connection with the drawing wherein.

DESCRIPTION OF THE PREFERRED EMBODIMENT

Figure 1:
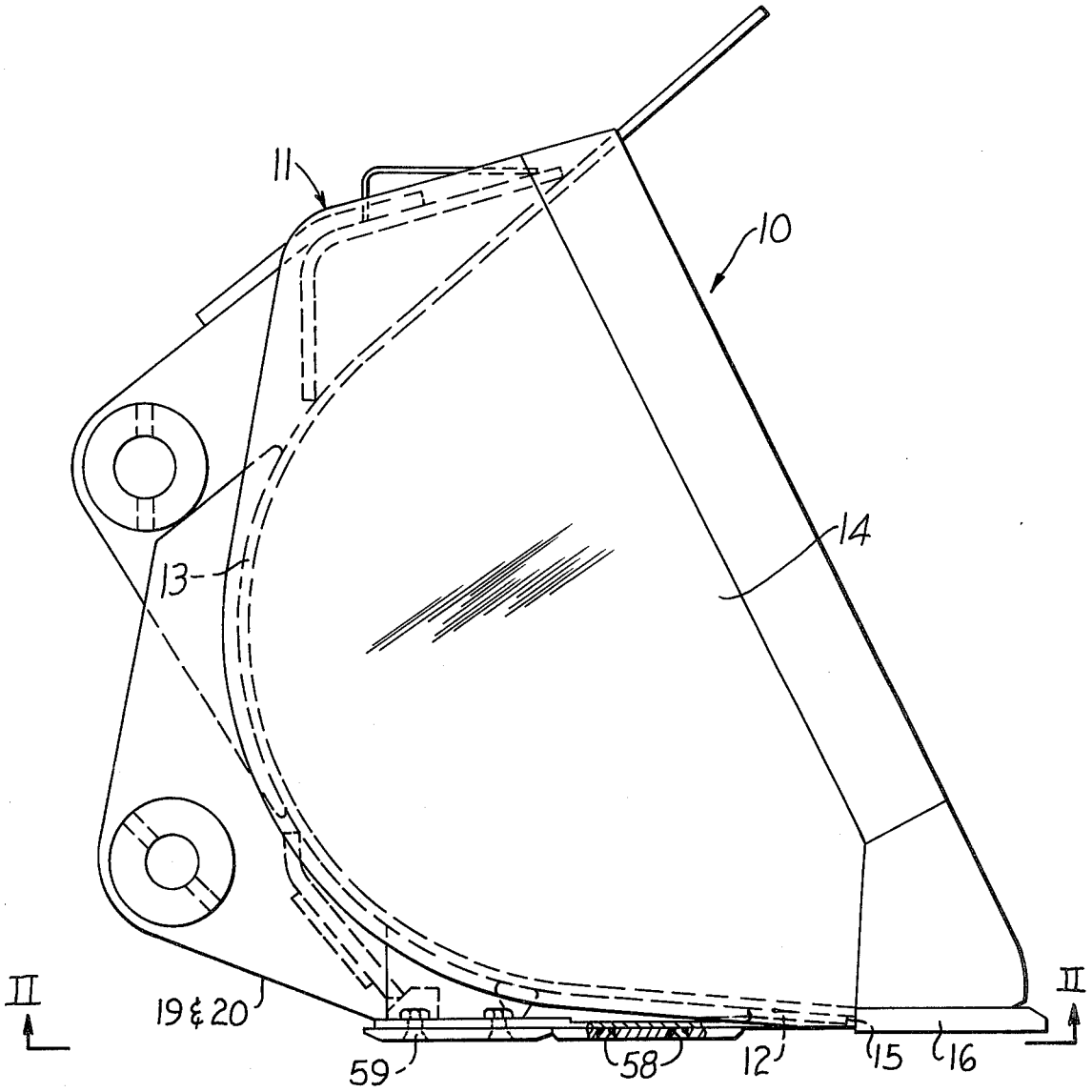
FIG. 1 is a side elevation of a bucket structure embodying the invention.

In the exemplary embodiment of the invention as disclosed in the drawing, a material handling bucket structure generally designated 10 includes a thin-walled shell 11 having a bottom wall 12, a rear wall 13, and opposite sidewalls 14. Bottom wall 12 defines a front edge 15 to which is secured a forwardly projecting blade 16.

Figure 2:
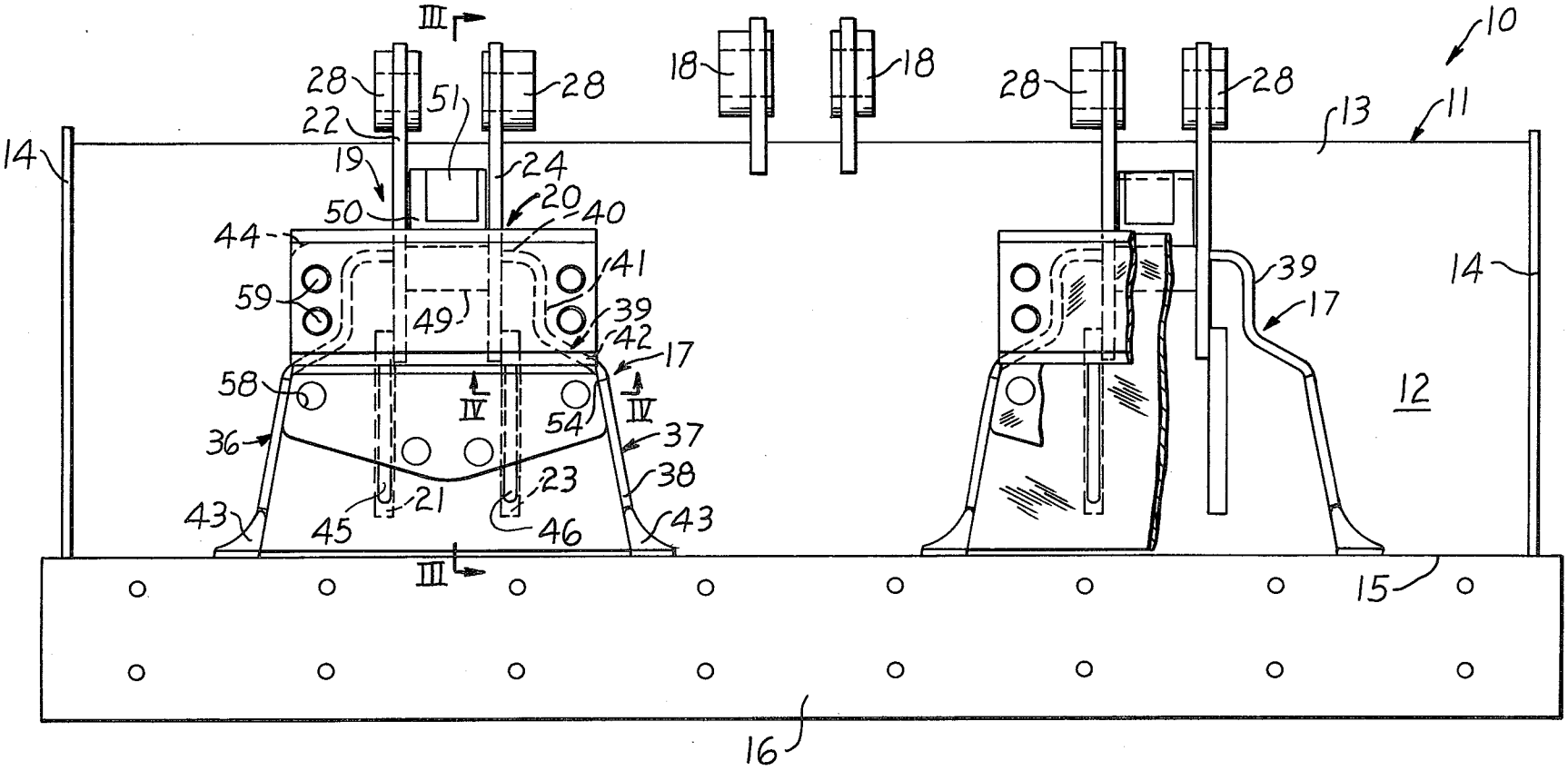
FIG. 2 is a bottom plan view thereof.

The present invention is concerned with an improved means for reinforcing the relatively thin wall shell. As shown in FIG. 2, a pair of reinforcing means generally designated 17 embodying the invention is provided inwardly of the opposite sidewalls 14 underlying the shell bottom wall 12 and extending rearwardly upwardly along the shell rear wall 13 to terminate each in a pair of linkage connectors 28 for connection of the shell to suitable powered manipulating means of the associated tractor, or the like. As further shown in FIG. 2, a second pair of linkage connectors 18 may be provided intermediate the reinforcing means 17 on the rear wall 13 to provide further manipulating support at the center of the shell.

Figure 3:
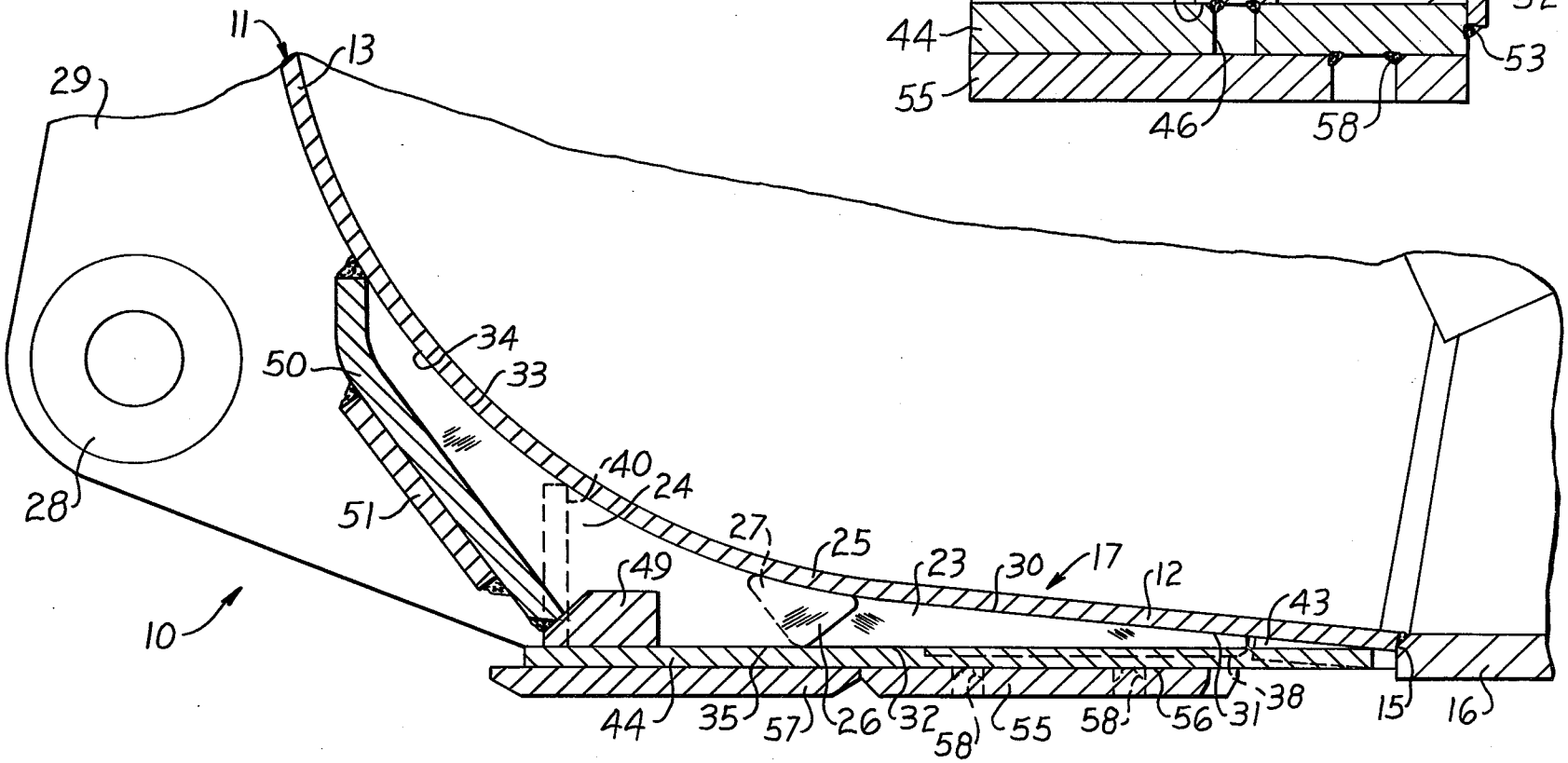
FIG. 3 is a fragmentary enlarged vertical section taken substantially along the line 3—3 of FIG. 2.

Each of the reinforcing and linkage mounting means 17 is similar and the following description will be limited to the lefthand (as seen in FIG. 2) means, it being understood that the description applies equally to the righthand means. More specifically, as best seen in FIGS. 2 and 3, each of the reinforcing means includes a first longitudinally extending rib 19 and a second longitudinally extending rib 20 spaced transversely inwardly from rib 19. Rib 19 includes a front portion 21 and a rear portion 22. Rib 20 includes a front portion 23 and a rear portion 24.

Rib front portions 21 and 23 extend to rearwardly from adjacent the front edge portion 15 of the shell to adjacent the juncture 25 of the bottom wall 12 and rear wall 13. The front edge portion 26 of rear rib portion 24 overlaps the rear edge portion 27 of the rib front portion 23 underlying juncture 25. As shown in FIG. 3, the connecting means 28 may be provided in a rearwardmost portion 29 of the rib rear portion 24 (22) rearwardly of the shell rear wall 13.

As best seen in FIG. 2, each of the rib front portions and rear portions is substantially rectilinear in plan. Each of the rib front portions defines an upper edge 30 conforming to the underside 31 of the shell bottom wall 12. The bottom edge 32 of the rib front portions is substantially flat.

The upper edge 33 of the rib rear portions is upwardly arcuate conforming to the underside 34 of the shell rear wall 13. The bottom edge 35 of the rear rib front edge portion 26 is substantially flat.

Figure 4:
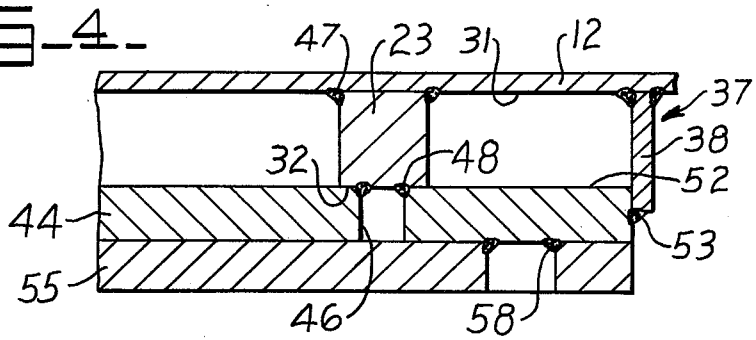
FIG. 4 is a fragmentary enlarged vertical section taken substantially along the line 4—4 of FIG. 2.

As further shown in FIG. 2, the reinforcing and connecting means 17 further includes a pair of outer ribs 36 and 37 extending forwardly and transversely away from ribs 19 and 20, respectively. As shown in FIGS. 2, 3 and 4, outer rib 37 (36) includes a front portion 38 extending downwardly from shell bottom surface 31 to slightly below the level of the bottom edge 32 of rib portion 23 (21).

The rear portion 39 of outer rib 37 (36) extends substantially at the level of the lower edge 35 of rib rear portion 24 (22). As shown in FIG. 2, rib portion 39 is substantially Z-shaped, having a rearwardmost first portion 40 extending transversely from rib portion 24, an intermediate longitudinal portion 41 extending generally parallel to rib portion 24, and a front portion 42 extending angularly transversely and longitudinally of the shell to the rear end of the front portion 38. As shown in FIG. 2, rib 36 is reversely identical to rib 37.

Ribs 36 and 37 terminate rearwardly of the front edge 15 of the shell. Braces 43 are provided extending intermediate the front edge of ribs 36 and 37 and the blade 16, braces 43 flaring transversely outwardly to provide the widened reinforcing support of the shell thereat.

As shown in FIG. 3, each reinforcement 17 further includes a bottom paddle plate 44. The paddle plate is provided with a pair of longitudinal slots 45 and 46 aligned with front rib portions 21 and 23, respectively, to permit welded securing of the paddle plate to the ribs. Thus, as shown in FIG. 4, the ribs may be secured to the underside 31 of shell 11 by suitable welds 47 and the paddle plate may be secured to the ribs by suitable welds 48 provided through the slots 46 (45).

A crossbar 49 is provided on the rear of the paddle plate 44 and extends between the first and second longitudinal rib rear portions 22 and 24, as shown in FIG. 2.

A rear plate 50 extends between crossbar 49 and shell rear wall 13 forwardly of the apertured linkage connector 28. As shown in FIG. 3, the rear plate 50 may be provided with a rear stop plate 51. As shown in FIG. 2, the rear plate 50 extends substantially between the rib rear portions 22 and 24 with the stop plate 51 being carried on the midportion thereof.

As shown in FIG. 3, outer rib front portion 38 extends downwardly below the level of the upper surface 52 of the paddle plate 44. Thus, the edge of the paddle plate may be secured to the lower edge of the outer rib portion 38 as by suitable welds 53. Rear portion 39 of the third and fourth outer ribs 36 and 37 overlies the paddle plate rear portion 44 being connected to the front portion 38 by an angled connecting portion 54 to provide the necessary transition in the disposition of the lower edge of the ribs 37 and 36.

To provide improved surface life of the bucket structure, a front wear plate 55 may be secured to the underside 56 of paddle plate 44 underlying the front portion 23 (21) of the first and second longitudinal ribs. A rear wear plate 57 may be secured to the underside 56 of paddle plate 44 underlying the rear portion 24 thereof. As shown in FIG. 2, the front wear plate may be secured to the paddle plate by means of a plurality of welds 58 and the rear wear plate may be secured to the paddle plate by a plurality of bolts 59.

Thus, the ribs 19, 20, 36 and 37 cooperate with the paddle plate 44 and the shell to define an improved box reinforcement permitting the shell to comprise a relatively thin wall thereby effectively minimizing the weight and facilitating handling thereof in material handling operations.

The provision of the linkage connectors on the longitudinal ribs permits the handling forces to be directed substantially directly to the reinforcement means rather than to the shell to provide further improved reinforced rigidty of the bucket structure.

The outer ribs 36 and 37 provide improved lateral stability of the reinforcing means by providing a transverse extension of the reinforcement to substantially laterally of the front portions 21 and 23 of the longitudinal ribs.

The removable wear plates provide for increased maintenance-free life of the bucket structure with the weld means 58 and bolt means 59 permitting facilitated replacement of the wear plate 57 as desired.

The different rib and plate structures may be secured to each other and the shell by suitable welds which may be effected in situ in the provision of the reinforcing means on the shell.

The bucket structure of the present invention comprises a further improvement over the bucket reinforcement structure of assignee's prior U.S. Pat. No. 3,853,232, as discussed above. The construction of the reinforcement means is extremely simple and economical while yet providing the highly improved reinforcement of the thin-walled shell as discssed above.

The foregoing disclosure of specific embodiments is illustrative of the broad inventive concepts comprehended by the invention.

The embodiments of the invention in which an exclusive property or privilege is claimed are defined as follows:

1. In a material handling bucket structure having a relatively thin shell defining a bottom wall having a front edge portion and an upturned rear portion, and defining an underside, and a blade secured to said front edge portion to project forwardly therefrom, improved reinforcing and mounting means comprising:

first and second generally straight longitudinal ribs secured to the underside of the shell, said ribs being spaced transversely of the shell, each rib extending from adjacent said front edge portion rearwardly to said rear portion and having a front rectilinear portion and a rear rectilinear portion;

third and fourth outer ribs secured to the underside of the shell, said third and fourth ribs extending forwardly and transversely outwardly from said rear portion of said first and second ribs respectively to adjacent said front edge portion of the shell; and a paddle plate spaced below said shell and secured to said ribs to define therewith and said shell a box section extending rearwardly from said blade to rearwardly of said third and fourth ribs and the front portion of said first and second ribs.

2. The material handling bucket structure of claim 1 wherein said third and fourth ribs define rectilinear front portions and said paddle plate defines side edge portions engaging the sides of said rectilinear front portions.

3. The material handling bucket structure of claim 1 wherein first and second brace members are provided extending between said blade and the forward ends of said third and fourth ribs respectively.

4. The material handling bucket structure of claim 1 wherein said paddle plate is provided with first and second slots aligned with the first and second rib front portions respectively, said first and second rib front portions being welded to said paddle plate by weld means provided in said slots.

5. The material handling bucket structure of claim 1 wherein said rear portion of each of the first and second ribs laterally overlaps the front portion thereof.

6. The material handling bucket structure of claim 1 wherein said paddle plate defines a rear portion, and said third and fourth ribs define rear portions overlying said paddle plate rear portion.

7. The material handling bucket structure of claim 1 wherein said paddle plate defines a rear portion, and said third and fourth ribs define rear portions overlying said paddle plate rear portion, said structure further including a wear plate underlying said rear portion of the paddle plate.

8. The material handling bucket structure of claim 7 wherein said wear plate is removably bolted to said rear portion of the paddle plate.

9. The material handling bucket structure of claim 7 wherein said wear plate projects rearwardly beyond said paddle plate.

10. The material handling bucket structure of claim 1 wherein a crossbar is secured in overlying relationship to said paddle plate between said first and second rib rear portions.

11. The material handling bucket structure of claim 1 wherein each of said first and second ribs defines an upper surface conforming to the confronting undersurface of the shell, and a planar bottom surface abutting the upper surface of said paddle plate.

12. The material handling bucket structure of claim 1 wherein said paddle plate defines a front edge portion secured to said blade.

13. The material handling bucket structure of claim 1 wherein said rear portions of said first and second ribs are provided with linkage connection apertures.

14. The material handling bucket structure of claim 1 wherein a cross plate is secured between said first and second rib rear portions rearwardly of the paddle plate.

15. The material handling bucket structure of claim 1 wherein a cross plate is secured between said first and second rib rear portions and to said shell rearwardly of the paddle plate.

16. The material handling bucket structure of claim 1 wherein a cross plate is secured between said first and second rib rear portions rearwardly of the paddle plate, a stop plate being secured to the underside of said cross plate intermediate said first and second rib rear portions.

17. The material handling bucket structure of claim 1 wherein a wear plate is secured to the underside of said paddle plate to extend forwardly of said rear portion of said first and second ribs to adjacent the front end of the front portion of said first and second ribs.

18. The material handling bucket structure of claim 1 wherein said front and rear portions of said first and second ribs comprise discrete rib members.

19. The material handling bucket structure of claim 1 wherein first and second brace members are provided extending between said blade and the forward ends of said third and fourth ribs respectively and projecting laterally from the side edges of said paddle plate.

* * * * *